United States Patent [19]

Biddle, III et al.

[11] 4,159,786

[45] Jul. 3, 1979

[54] PERIODICALLY EXCITED LEVEL CONTROL PROBE

[75] Inventors: Nicholas Biddle, III; Roger A. Patterson, both of Wilmington, Del.

[73] Assignee: E. I. Du Pont de Nemours and Company, Wilmington, Del.

[21] Appl. No.: 850,670

[22] Filed: Nov. 11, 1977

[51] Int. Cl.[2] ..... G03G 13/00

[52] U.S. Cl. ..... 222/64; 73/290 V; 73/574; 222/DIG. 1; 222/239

[58] Field of Search ..... 73/290 V, 574, 579; 222/56, 64, DIG. 1, 239

[56] References Cited

U.S. PATENT DOCUMENTS

| | | | |
|---|---|---|---|
| 3,300,091 | 1/1967 | Wondrak et al. | 222/64 X |
| 4,008,613 | 2/1977 | Myers | 73/290 V |
| 4,107,994 | 8/1978 | Sogo | 73/290 V |

*Primary Examiner*—David A. Scherbel

[57] ABSTRACT

A copy machine having a decorator for applying toner to a latent image is disclosed. The decorator is fitted with a control for sensing the level of toner in the decorator sump which control automatically maintains the amount of toner in the sump at the desired level. The control includes a toner level sensor which is a vibrating rod driven by a decorator roll.

9 Claims, 7 Drawing Figures

PERIODICALLY EXCITED LEVEL CONTROL PROBE

BACKGROUND OF THE INVENTION

1. Field of the Invention

The present invention relates to a toner level control device useful in an apparatus for dry printing of information. The apparatus utilizes a drum or other member containing a latent magnetic image or electrostatic image to which toner particles are applied by means of a decorator. The decorator is one or more rotatable rolls immersed in a sump of toner particles which must be replenished. Accurate control of the level of toner in the sump enables more uniform application of toner to the latent image on the drum.

2. Description of the Prior Art

Both Xerography and magnetography are known. Xerography involves: forming an electrostatic charge on a photoconductive material such as selenium; imagewise exposing the photoconductive material to light whereby the exposed areas lose their charge; and applying a pigmented, finely divided, electrically charged powder which is attracted to and held on the electrostatic image. The charged toner image is then transferred to copy paper either with an opposite electrostatic charge or by means of pressure.

In magnetography a magnetic image is formed, and ferromagnetic particles applied thereto which adhere to the magnetized areas of the image. The particles are then transferred to copy paper.

The broad aspect of using the damping action of the material which level is being controlled on a constantly driven sensing element has been used for many years.

SUMMARY OF THE INVENTION

The present invention relates to a control device for maintaining the desired level of toner in the decorator of a magnetic or electrostatic copy machine. The control utilizes a probe which is intermittently mechanically plucked to cause it to vibrate harmonically. The probe is connected to an electric detector which is adapted to sense whether the vibrations of the probe are decaying due to the probe being in contact with toner. The electric detector is electrically connected to drive means which actuates a valve in a supply line which feeds toner from a supply source to the sump of the decorator.

Existing commercial vibratory-probe bin level sensors are deficient for the present purpose in terms of their size which is large and their cost which also is large.

The availability of space in a toner decorator is extremely tight. There is an extended surface but little width available for a probe to be inserted. Hence it is necessary to use a thin rod-like probe as the sensor. The commercial probes are too thick. The problem is further compounded by the fact that the material being sensed is of extremely low density, fluidized powder which has a tendency to compact. These properties prevent using floats, moving vanes, paddles and such which are also known even if one could be made to fit the limited space. Thus the damped-vibration principle is attractive if the probe can be made slim enough and if cost can be minimized. The commercial probes, however, are electrically and continuously driven, a factor adding to their cost and making a miniaturized version of existing models impractical.

It is the object of this invention to overcome these deficiencies of size and cost in damped vibration sensors.

DETAILED DESCRIPTION OF THE DRAWINGS

Figure 1:
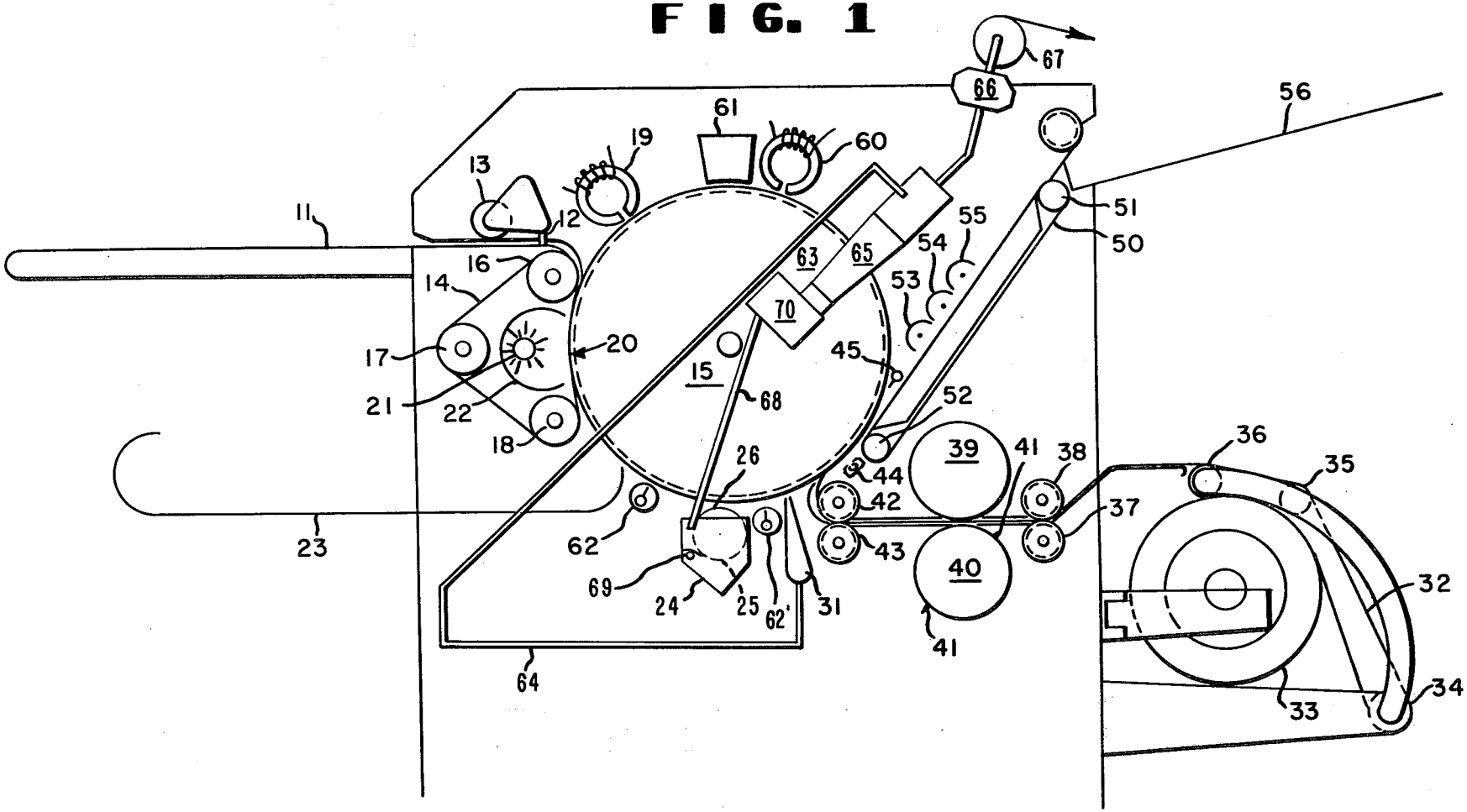
FIG. 1 is a schematic representation of a magnetographic copying machine shown in conjunction with the toner supply system and toner level control of this invention.

Referring to FIG. 1, the document which is to be copied is placed on shelf 11 and urged against gate 12. The copier is then activated to lift gate 12 and lower feed roll 13 into contact with the document. Feed roll 13 feeds the document into the nip between endless belt 14 and drum 15. Endless belt 14 is made of a transparent film such as poly(ethylene terephthalate) about 2–7 mils (0.05–0.18 mm) in thickness. Rollers 16, 17, and 18 serve to drive and guide endless belt 14. The surface of drum 15 is preferably a poly(ethylene terephthalate) film about 5 mils (0.13 mm) in thickness. The convex surface of this film is coated with a conductive layer such as by being aluminized with a layer of aluminum to a surface resistivity of 1 to 1,000 ohms. The aluminum layer preferably is grounded. The conductive support may also be a plastic such as polyoxymethylene sleeve coated or formulated with aluminum, nickel, copper or other conductive material. The support may also be the conductive metal itself. The surface of the aluminum is coated with a layer of ferromagnetic material such as acicular chromium dioxide in an alkyd or other suitable binder. Generally, the acicular chromium dioxide layer is from 0.001 to 0.012 mm in thickness and contains from 40 to 85 weight percent acicular chromium dioxide and from 15 to 60 weight percent alkyd or other suitable resin binder. Suitable acicular chromium dioxide can be prepared in accordance with the teachings of U.S. Pat. No. 2,956,955, issued Oct. 18, 1960, to Paul Arthur, Jr. However, the preferred acicular chromium dioxide particles are produced by techniques disclosed in U.S. Pat. Nos. 2,923,683 and 3,512,930.

Drum 15 rotates in a counterclockwise direction. The ferromagnetic coating on the drum is magnetized by premagnetizer 19, which records a periodic pattern. A number of techniques are known for doing this magnetic structuring. We find 300 to 1000 magnetic reversals per inch (12 to 40 per mm) on the magnetizable surface to be a working range and prefer about 400–600 magnetic reversals per inch (15 to 24 per mm).

Alternatively, a film structured by grooves containing acicular chromium dioxide can be used for the surface of drum 15 in which case a simple DC magnet can be used as premagnetizer 19. Generally from 200 to 300 grooves per inch (7.5 to 12 per mm) across the drum will be used giving 400 to 600 magnetic reversals per inch (15–24 per mm).

The magnetized drum surface in contact with the document is then moved past an exposure station indicated generally at 20. The exposure station consists of lamp 21 and reflector 22. A suitable lamp 21 is a xenon flash, which has a color temperature equivalent to 6000° C. The surface of drum 15 is exposed stepwise until the entire document has been recorded as a latent magnetic image on the surface of drum 15. The chromium dioxide as used herein has a Curie temperature of about 116° C. The marking of the document being copied, pencil lines, printing or the like, shade the areas of the chromium dioxide over which such markings are situated during exposure thereby preventing these areas reaching the Curie point. Thus, after exposure, the surface of the drum will have magnetized areas of chromium dioxide corresponding to the marked areas of the translucent document being copied.

After exposure, the document being copied is dropped into tray 23.

The imagewise magnetized drum 15 is rotated past a toner decorator. The toner decorator comprises a trough 24 fitted with rapidly rotating roll 25 and bar 26. Static eliminator 62 removes any static charges prior to the toner decorator and static eliminator 62' removes any charges on toner particles that emerge from the toner decorator. A vacuum knife 31 is used to remove whatever toner partices may have adventitiously become attached to the demagnetized areas of the chromium dioxide on the surface of drum 15.

The paper 32 on which the copy is to be made is fed from roll 33 around idler rolls 34, 35, 36 to feed rolls 37 and 38. Backing roll 39 cooperates with roll 40 equipped with cutting edges 41. Rolls 39 and 40 are activated by means not shown to cut the paper 32 to the same length as the length of the document being copied. The paper is then fed by feed rolls 42 and 43 into physical contact with the surface of drum 15. The paper 32 in contact with the surface of drum 15 is fed past corona discharge device 44. Corona discharge device 44 preferably is of the type known as a Corotron which comprises a corona wire spaced about 11/16" (17.5 mm) from the paper and a metal shield around about 75 percent of the corona wire leaving an opening of about 90° around the corona wire exposed facing the paper 32. The metal shield is insulated from the corona wire. The metal shield is maintained at ground potential. Generally the corona wire will be from 0.025 to 0.25 mm. in diameter and will be maintained at from 3000 to 10000 volts. The corona wire may be at either a negative or a positive potential with negative potential being preferred. The Corotron 44 electrostatically charges the back side of paper 32. This lightly pins the paper to the drum, and upon separation of the paper from the drum has caused image-wise transfer of toner particles to paper 32. At the region in which paper 32 separates from the surface of drum 15 under the action of endless vacuum belt 50, the toner particles remain held in image-wise fashion to paper 32. We have observed that Corotron 44 should be disposed over the arc of intimate contact for best results. If Corotron 44 is not so located or if there are forces present preventing the paper 32 from forming an arc of intimate contact, the resultant image becomes fuzzy. There is only a light amount of pressure between paper 32 and the surface of drum 15 (i.e., merely enough to hold them adjacent each other). The pressure between paper 32 and drum 15 is essentially entirely generated by the electrostatic attraction generated by corona discharge device or Corotron 44. Nevertheless transfer efficiency is surprisingly high and approaches 100% for toners with nontacky surface characteristics and low conductivity. The paper 32 is then removed from the surface of drum 15 by the action of the vacuum belt 50 in conjunction with the action of puffer 45 that forces the leading edge onto the surface of endless vacuum belt 50 driven by rollers 51 and 52. Endless vacuum belt 50 transports paper 32 past infrared lamps 53, 54, 55 which heat the thermoplastic resin encapsulating the ferromagnetic material in the toner particles causing them to melt and fuse to the paper 32. The decorated paper 32 is then fed into hopper 56.

When multiple copies of the same document are to be made, a control means, not shown, is so actuated that drum 15 is continuously rotated without activating demagnetizer 60, vacuum box 61, magnetizer 19 or lamp 21 because the electrostatic transfer of the toner particles does not affect the magnetic state in the chromium dioxide layer on the surface of drum 15. Many copies can be printed from a single exposure at speeds of up to 300 feet/minute. Over 10,000 copies from a single image have been demonstrated. Demagnetizer 60 and vacuum box 61 are activated to remove the latent image and clean the surface of drum 15 before imaging a new document.

The toner supply system is indicated generally as 63. It comprises low pressure pipe 64, cyclone separator 65, filter 66, blower 67, gravity supply duct 68, toner reserve 70, and toner level sensor 69 installed at an appropriate location in decorator trough 24. Vacuum knife 31, as has been described in the copier operation recital, removes toner particles from the surface 26 of drum 15. These particles are carried through low pressure pipe 64 into cyclone separator 65 under the influence of blower 67 which is connected to cyclone separator 65 by suitable piping through filter 66. Toner particles separated from the air stream in cyclone separator 65 fall into main toner reserve 70 whose contents are metered upon demand from toner level sensor 69, in a manner to be described later in detail, through gravity duct 68 to decorator 24 to insure suitable operation.

Figure 2:
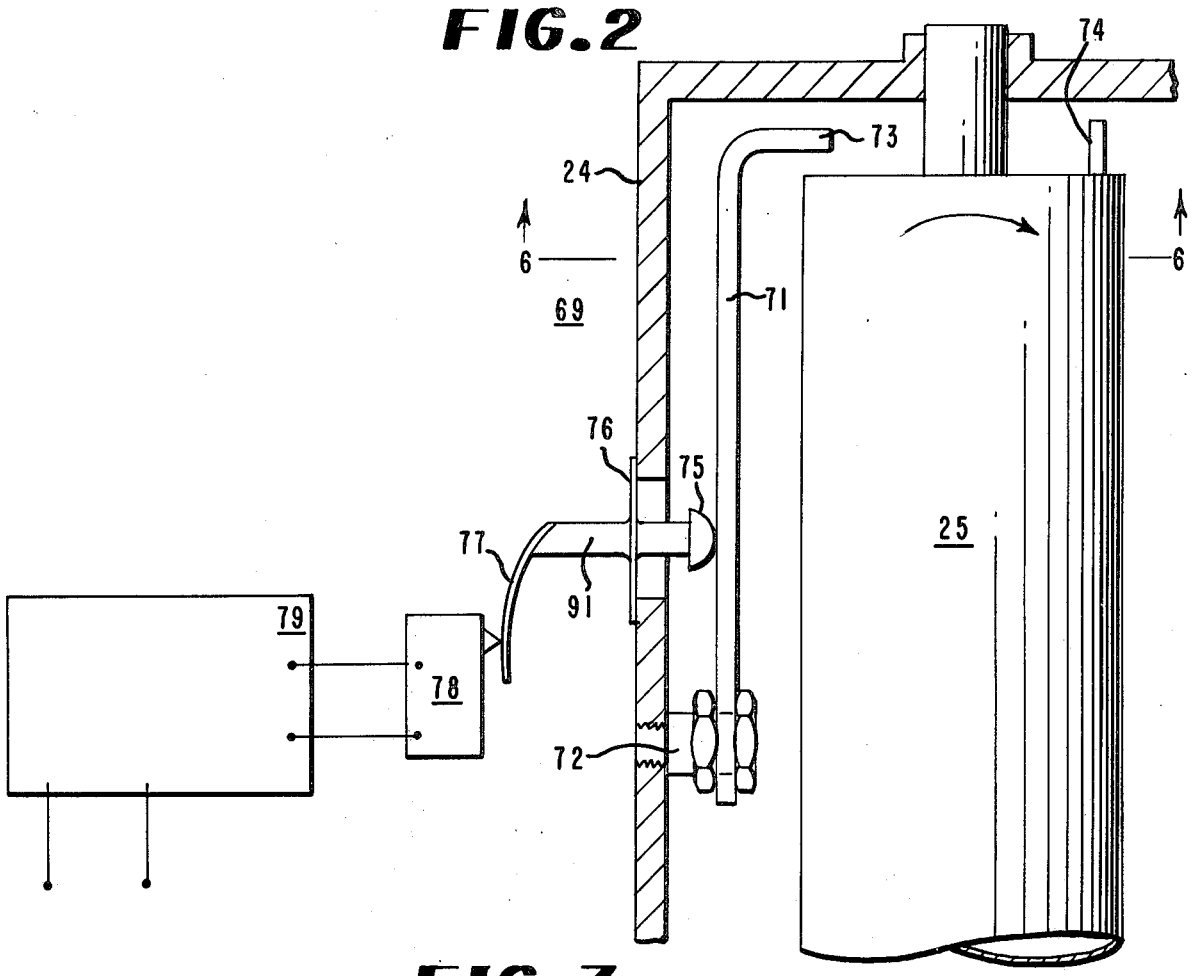
FIG. 2 is a partial cross-section of the toner decorator showing the toner level detector.
Figure 3:
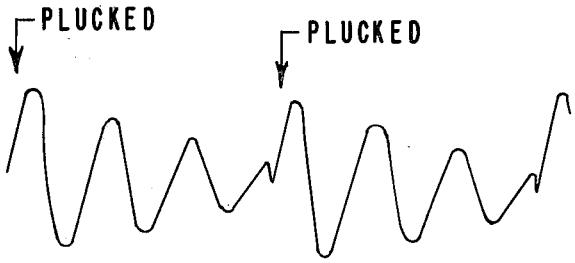
FIG. 3 is a schematic plot of the pickup signal without toner around the sensor rod.
Figure 4:
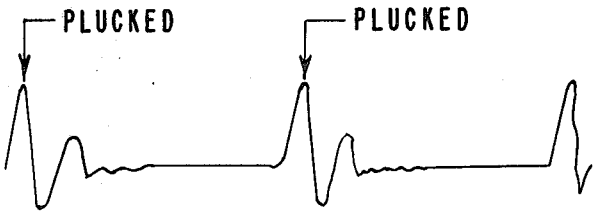
FIG. 4 is a schematic plot of the pickup signal with toner around the sensor rod.
Figure 6:
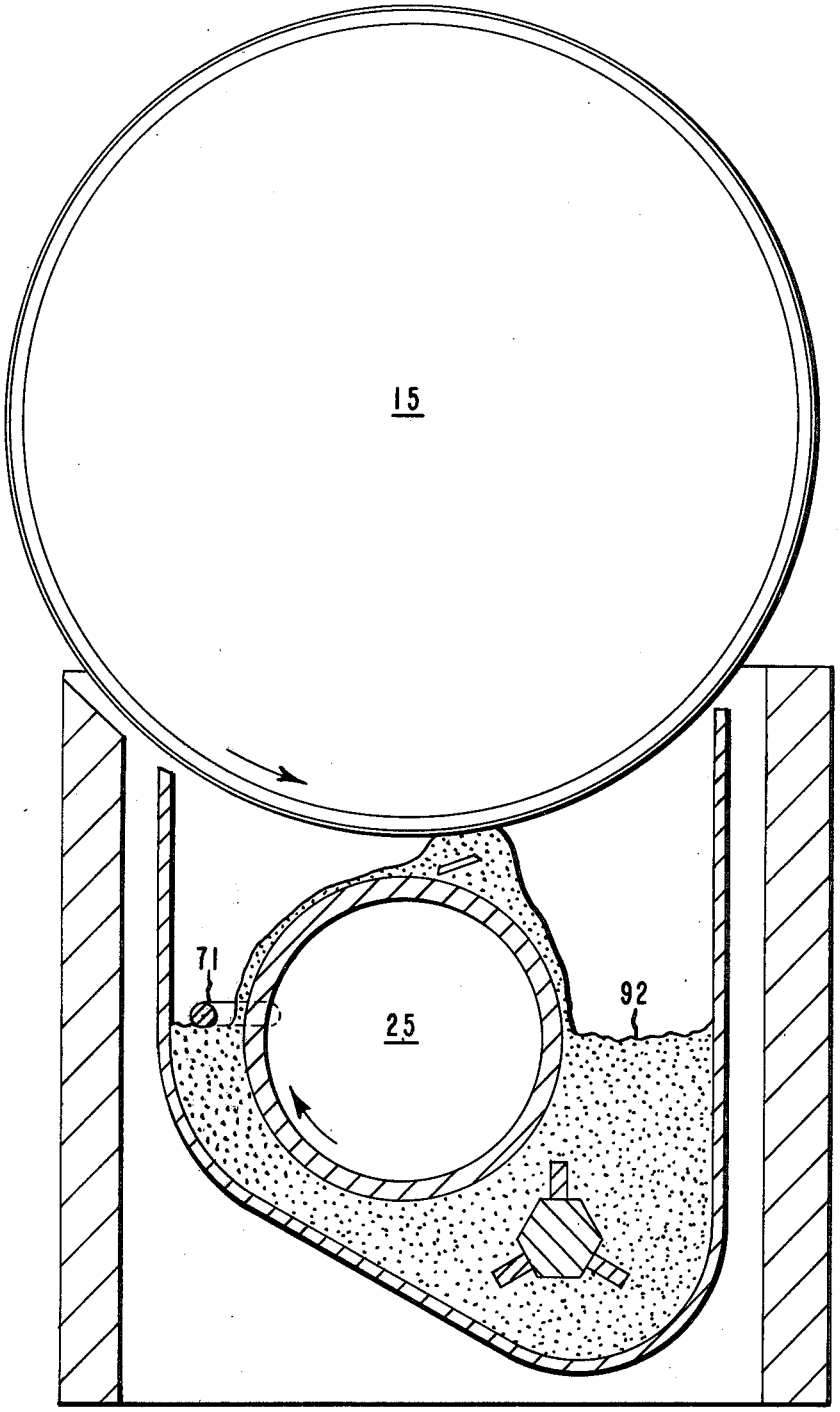
FIG. 6 is a cross-sectional view of the decorator and toner level sensor taken on line V1—V1 of FIG. 2.

Referring now to FIG. 2 decorator roll 25 is supported in bearings in trough 24 which is filled to a suitable level 92 with toner (as best seen in FIG. 6). The toner level sensor indicated generally by 69, is a relatively simple but effective device. Toner level sensor rod 71, which is fabricated from a ⅛ inch diameter spring steel rod is fastened by mounting assembly 72 to trough 24 so that sensor rod 71 lies parallel to the axis of roll 25 at desired level 92 as shown. Sensor rod 71 need not be straight but may be bent providing it lies in the plane of level 92. The preferred shape shown in FIG. 2 features a right-angle bent tip 73 so disposed that it is struck once per revolution of roll 25 by plucking pin 74. This excites sensor rod 71 which vibrates at its natural frequency decaying in amplitude with time until struck again. The nature of the decay pattern depends on damping as is well known. Thus, the presence or absence of toner around sensor rod 71 significantly affects this decay pattern as seen in FIGS. 3 and 4. As can be seen it is advantageous in sensing the vibration of the probe if the natural frequency thereof is at least twice that at which it is being struck. To insure reliable operation ratio is at least 10 to 1. This value results from the light, fluffy character of the toner which is fluidized and hence does not induce a rapid decay of the vibration amplitude of the system.

The vibration of sensor rod 71 is transmitted to rod 91 which has a button-head 75 in spring-loaded frictional engagement with the shaft of sensor rod 71 relatively near its base, the object being to transmit motion from rod 71 to rod 91 without damping rod 71. Rod 91 is mounted resiliently to trough 24 by diaphragm spring 76 which may suitably be fabricated from 4-mil brass. The base of rod 91 has a spring-arm 77 in contact with pickup 78 which may be a phonograph cartridge or any similar transducer. We use a piezoelectric pickup. Thus, vibration of sensor 71 is transmitted via buttonhead 75 through rod 91 and spring-arm 77 to (piezoelectric) pickup 78 where an electric signal analagous to the vibration is generated. This is fed to average signal power detector 79 which is a device providing either an "off" or an "on" output signal depending on the mean level of the input signal received from pickup 78. We employ spring-arm 77 to actuate pickup 78 to permit trough 24 to be removed in its entirety by sliding, on suitable tracks not shown, for the purpose of maintenance. Trough 24 is not encumbered with any electrical wire connections which makes its removal difficult there being no active electrical devices within trough 24.

Comparing FIG. 3 with FIG. 4, it is seen that the signal with no toner around sensor rod 71 has a higher average power (area under the curve) than when toner is around sensor rod 71 and dampens the vibration rapidly to zero level. Having disposed sensor rod 71 at the desired level of toner 70, we thus have an "off" signal when toner is at or above level 70 and an "on" signal when toner is below that level.

Figure 5:
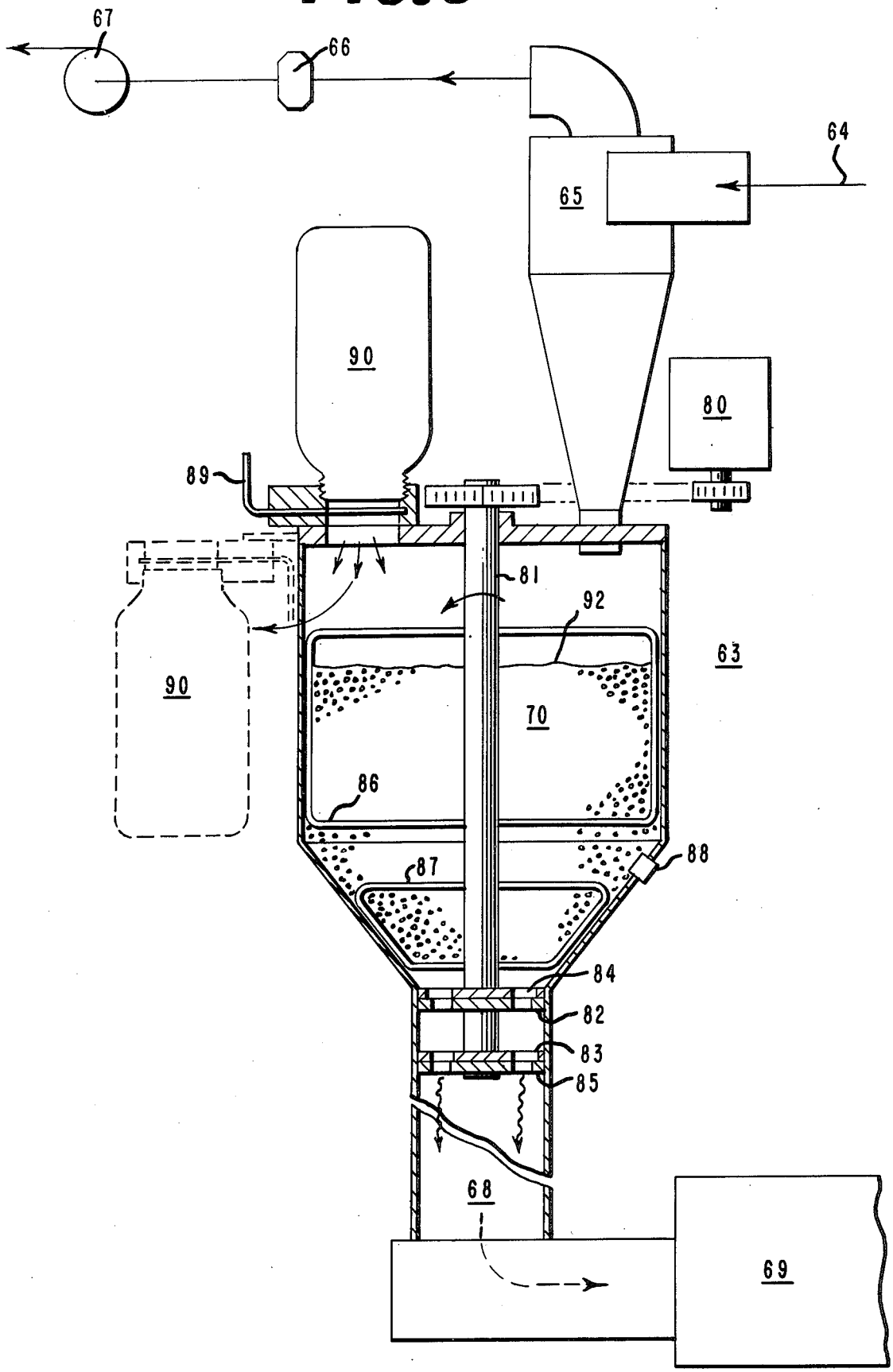
FIG. 5 is an enlarged schematic representation of the toner supply system of this invention.

An "on" output from detector 79 is a "call" for replenishing a fallen level of toner in decorator trough 24. This output activates the toner supply system 63 as best seen in FIG. 5. Motor 80 turns driving shaft 81 which is mounted on bearings in toner reserve 70. Shaft 81 carries a pair of rotary valves 82 and 83 which are in facing engagement with valve plates 84 and 85, respectively. These valve plates are perforated as are the rotary valves in a manner such that the "open-shut" relationship of the upper combined valve and valve plate 82 and 84 is out of phase with the "shut-open" relationship of the lower combined valve and valve plate 83 and 85. Thus, blower 67 maintains a negative pressure in cyclone separator 65 and toner reserve 70 that is not communicated to gravity duct 68. Toner, however, feeds by gravity through the valves essentially in discrete slugs having a volume approximating the volume between valves 82 and 83. Stirrers 86 and 87 are fastened to shaft 81 and serve to fluidize the contents of toner reserve 70 making feeding easier and preventing bridges. When enough toner has been fed to raise the level in the decorator trough 24 to level 70 an "off" signal condition ensures and motor 80 stops.

Toner reserve 70 becomes depleted in time by successive "on" cycles and a replenishment system is provided. When the level falls to the vicinity of the top of lower stirrer 87, toner level sensor 88 is actuated. At this location, a commercial bin-level indicator is used and the output signal alerts the operator by means not shown. The operator closes slide valve 89 and swings toner supply bottle 90, through 180° to the mounth-up position shown in phantom lines. The operator removes and replaces bottle 90 with a fresh container and the bottle handling process is reversed.

Figure 7:
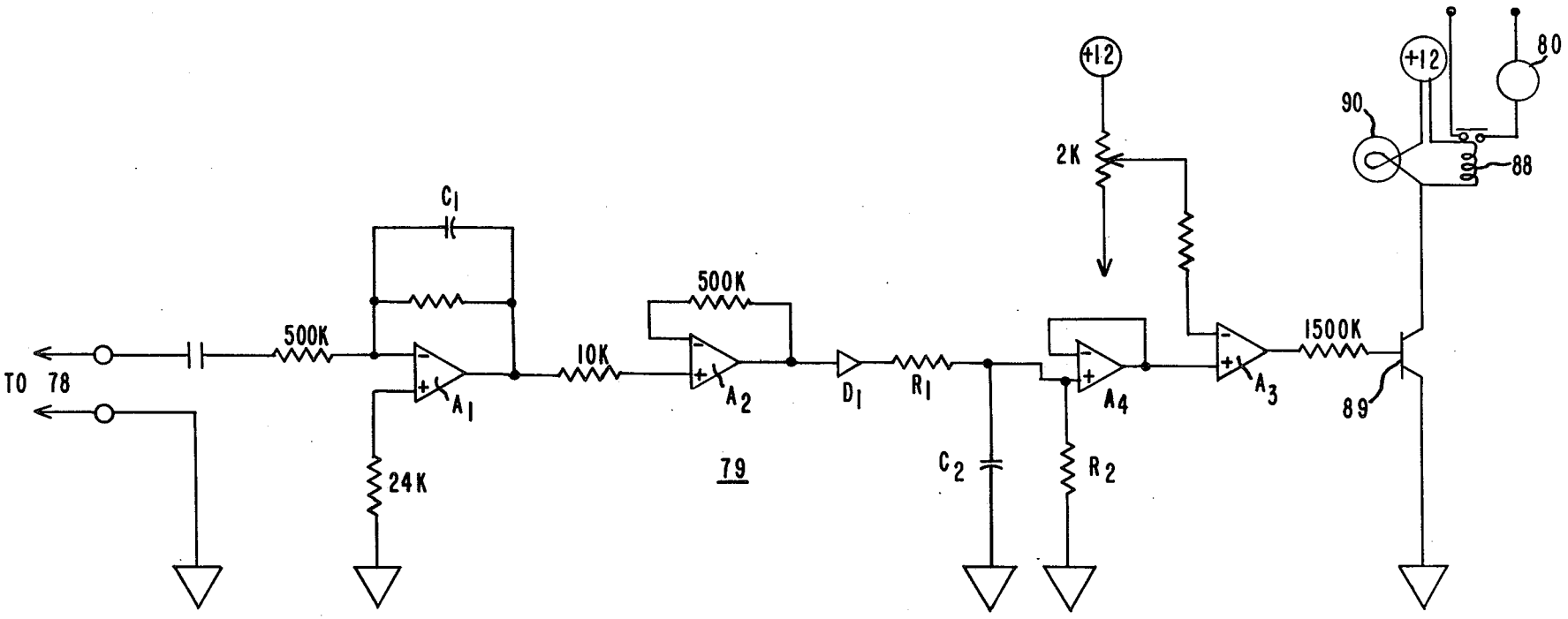
FIG. 7 is an electrical schematic representation of a circuit which may be employed with the vibrating rod toner level sensor of this invention.

The circuit shown in FIG. 7 is preferred to use in the average singla power detector 79. However, there are other circuits which can perform the same function. $A_1$ is a high input impedance low pass amplifier associated with capacitor $C_1$ which attenuates higher frequencies. $A_2$ is a voltage amplifier with a gain of about 50. Diode $D_1$, in association with $C_2$ is what we call a "leaky" integrator. Amplifier $A_4$, in association with resistor $R_1$, resistor $R_2$, and capacitor $C_2$ provides a low impedance output to amplifier $A_3$ to minimize the sensitivity of the circuit to individual amplifier characteristics. The values of $R_1$ and $R_2$ relative to $C_2$ are selected, as is known in the art, to provide appropriate charge up and decay times for capacitor $C_2$. $A_2$ is a voltage comparator that turns the transistor 89 on when the integrator voltage rises above the voltage at the inverting terminal of amplifier $A_3$. This starts motor 80 and lights indicator 90. The motor is actuated by power relay 88.

Umdamped vibrations of sensor rod 71, signifying low toner, cause a series of unipolar pulses to be applied to the integrator circuit raising its voltage level and switching the output. The pulses are just the highly amplified and half-wave rectified output of the piezoelectric pickup 78. When the sensor rod 71 is dampened by toner, strong shocks may still get through, as at the moment of plucking, but they will not persist long enough to raise the integrator voltage above threshold due to leakage characteristics of amplifier $A_3$ and resistor $R_2$.

The invention provides a clean cost-effective toner supply system with a low-cost, extremely compact, low-maintenance, easily removed, and highly effective toner level control for a toner decorator useful in reproduction processes and apparatus employing particulate toner.

I claim:

1. An apparatus for controlling the level of toner particles in the sump of a decorator adapted to apply toner particles to a latent image said decorator containing at least one rotatable member, adapted to periodically strike a probe rod located within said sump and capable of vibrating whereby said probe is caused to vibrate, sensor means to sense whether or not the vibration of the probe is being damped by toner particles in the sump, drive means actuated by said sensor means adapted to add toner to said sump when the vibration of the probe is not being damped by toner.

2. The apparatus of claim 1 wherein the probe when not engaging toner has a natural frequency of vibration of at least twice the frequency with which the rotatable member is adapted to strike the probe.

3. The apparatus of claim 2 wherein said natural frequency of vibration is at least 10 times the frequency with which the rotatable member is adapted to strike the probe.

4. The apparatus of claim 3 wherein the toner is fed from a supply reserve by gravity to the decorator sump.

5. The apparatus of claim 4 wherein the drive means actuates a valve permitting toner to flow into the sump.

6. The apparatus of claim 5 wherein the probe is a rod.

7. The apparatus of claim 6 wherein the rod is stuck by means attached to a decorator roll in the decorator sump.

8. The apparatus of claim 7 wherein the means to sense vibration of the probe rod is an electrical means.

9. The apparatus of claim 8 wherein said electrical means is an average signal power detector producing an off or an on output signal adapted to actuate said drive means.

* * * * *